US010151483B2

(12) United States Patent
Abate et al.

(10) Patent No.: US 10,151,483 B2
(45) Date of Patent: Dec. 11, 2018

(54) METHOD FOR MONITORING AND CONTROLLING COMBUSTION IN FUEL GAS BURNER APPARATUS, AND COMBUSTION CONTROL SYSTEM OPERATING IN ACCORDANCE WITH SAID METHOD

(71) Applicant: SIT S.p.A., Padua (IT)

(72) Inventors: Maurizio Achille Abate, Bologna (IT); Loris Bertoli, Maserà di Padova (IT); Alessandro Franch, Castelfranco Veneto (IT); Giancarlo Pirovano, Martellago (IT)

(73) Assignee: SIT S.P.A., Padua (IT)

( * ) Notice: Subject to any disclaimer, the term of this patent is extended or adjusted under 35 U.S.C. 154(b) by 793 days.

(21) Appl. No.: 14/431,469

(22) PCT Filed: Sep. 20, 2013

(86) PCT No.: PCT/IB2013/058698

§ 371 (c)(1),
(2) Date: Mar. 26, 2015

(87) PCT Pub. No.: WO2014/049502

PCT Pub. Date: Apr. 3, 2014

(65) Prior Publication Data

US 2015/0276221 A1 Oct. 1, 2015

(30) Foreign Application Priority Data

Sep. 27, 2012 (IT) ..... PD2012A0281

(51) Int. Cl.
*F23N 5/12* (2006.01)
*F23N 1/00* (2006.01)

(52) U.S. Cl.
CPC ..... *F23N 5/123* (2013.01); *F23N 1/002* (2013.01); *F23N 5/12* (2013.01); *F23N 2023/06* (2013.01);
(Continued)

(58) Field of Classification Search
None
See application file for complete search history.

(56) References Cited

U.S. PATENT DOCUMENTS 5,472,336 A * 12/1995 Adams ..... F23N 5/123 431/16
5,473,162 A * 12/1995 Busch ..... G01N 21/71 250/339.08

(Continued)

FOREIGN PATENT DOCUMENTS

DE 10220772 A1 11/2003
WO 2004015333 A2 2/2004
WO 2011117896 A1 9/2011

*Primary Examiner* — Kenneth Rinehart
*Assistant Examiner* — Deepak Deean
(74) *Attorney, Agent, or Firm* — Volpe and Koenig, P.C.

(57) ABSTRACT

A method is provided for monitoring and controlling combustion in a burner of a fuel gas apparatus, having a sensor with an electrode able to be supplied by a voltage generator and connected to an electronic circuit for measuring the resultant potential. The method includes acquiring and processing data from experimental conditions and a second phase of evaluating the desired combustion characteristic, under an actual operating condition of the burner. A plurality of experimental combustion conditions for the burner are preselected, applying to the burner, in each condition, a power and a further significant parameter of the combustion characteristics, under each of the experimental conditions applying an electrical voltage signal to said electrode and carrying out a sampling of the response signal, calculating, based on the sequence of sampled values, the characteristic
(Continued)

parameters of the waveform of the signal for each of the experimental conditions.

18 Claims, 2 Drawing Sheets

(52) U.S. Cl.
CPC ..... *F23N 2023/10* (2013.01); *F23N 2025/30* (2013.01); *F23N 2033/08* (2013.01)

(56) References Cited

U.S. PATENT DOCUMENTS 6,693,433 B2 * 2/2004 Schmidt ..... F23D 14/725 324/468
6,901,351 B2 * 5/2005 Daw ..... B01D 1/0058 700/274
7,353,140 B2 * 4/2008 Daw ..... F23M 11/045 340/500

* cited by examiner

METHOD FOR MONITORING AND CONTROLLING COMBUSTION IN FUEL GAS BURNER APPARATUS, AND COMBUSTION CONTROL SYSTEM OPERATING IN ACCORDANCE WITH SAID METHOD

TECHNICAL CONTEXT

The present invention relates to a method for monitoring and controlling combustion in fuel gas burners for apparatus such as boilers, hot water cylinders, fireplaces and the like, with the features mentioned in the preamble of the main claim. It also relates to a combustion control system operating in accordance with said method.

TECHNOLOGICAL BACKGROUND

In the reference technical sector it is known that, to maintain efficient combustion, it is necessary for the ratio between the amount of air and the amount of fuel gas introduced into the burner to be maintained at around a predetermined optimal value, which depends substantially on the type of gas used and, in general, can also depend on the value of the power delivered by the burner, i.e. by the gas flow rate.

In this way a complete combustion process can be achieved and maintained over time without excessive energy loss as fumes, while minimising the production of polluting gases and complying with emissions legislation in the various countries.

To achieve this objective of maintaining the optimal air/gas ratio, various devices and methods have been developed in the reference technical sector.

In the specific scope of the invention, there are known methods for monitoring and controlling combustion on the basis of flame analysis and, in particular, analysis of the gas ionisation in the combustion zone of the flame. Typical methods provide for the use of an electrode which is placed in or close to the flame zone and connected to an electronic circuit that applies a fixed or variable voltage to the electrode and measures the current passing through said electrode. One or more combustion-related parameters are estimated by means of systems for processing and analysing the current signal. The processing systems include known methods for analysing the frequency spectrum of the signal, which analysis is capable of identifying frequency spectra or variations of the same that indicate flame instability or sub-optimal combustion, on the basis of which, systems for correcting the combustion are provided in order to return the latter to the desired conditions.

Identifiable limitations of the known methods relate mainly to the reliability of the results of the frequency spectrum analyses and to their correlation with the combustion process.

Limitations can also be encountered in the possible wear and ageing of the electrode for receiving the signal in the ionisation sensor, with consequent repercussions on the reliability and accuracy of the data analysed by the frequency spectrum processing algorithms.

The aforesaid limitations are also amplified if the combustion control is to be carried out in burners of the modulating type, in which optimal combustion conditions are sought by varying the required power, within the range between minimum power and maximum admissible power for the burner.

It is also known that the volumetric ratio between the gas flow rate and the air flow rate appropriate for correct combustion also depends on the type of gas. Therefore, each family of fuel gases is correlated with respective, specific control curves (which, for example, correlate the gas flow rate with the air flow rate). One of the problems of known systems for controlling combustion consists is identifying the family of gases and associating the optimal control curves.

DESCRIPTION OF THE INVENTION

The problem addressed by the present invention is that of producing a method for monitoring and controlling combustion in a burner of fuel gas apparatus, and also a combustion control system operating in accordance with said method, which are structurally and functionally designed to overcome the limitations set out above with reference to the cited prior art.

Within the context of this problem, one object of the invention is to make available a control method and system that are capable of ensuring optimal combustion throughout the range of flow rates (and for various gas types), i.e. the powers for which the burner size is intended, ensuring reliable and repeatable results when analysing signals correlated with the combustion process.

Another object of the invention is to offer a control method and system that is simple to manage and characterise, during both installation and use of the burner of the apparatus.

This problem is solved and these objects are achieved by the present invention through a method and a system for controlling combustion in a burner of a fuel gas apparatus, implemented according to the claims which follow.

BRIEF DESCRIPTION OF THE DRAWINGS

The features and advantages of the invention will become more apparent from the detailed description of a preferred embodiment thereof, shown non-restrictively and for information with reference to the attached drawings in which.

PREFERRED EMBODIMENTS OF THE INVENTION

Figure 1:
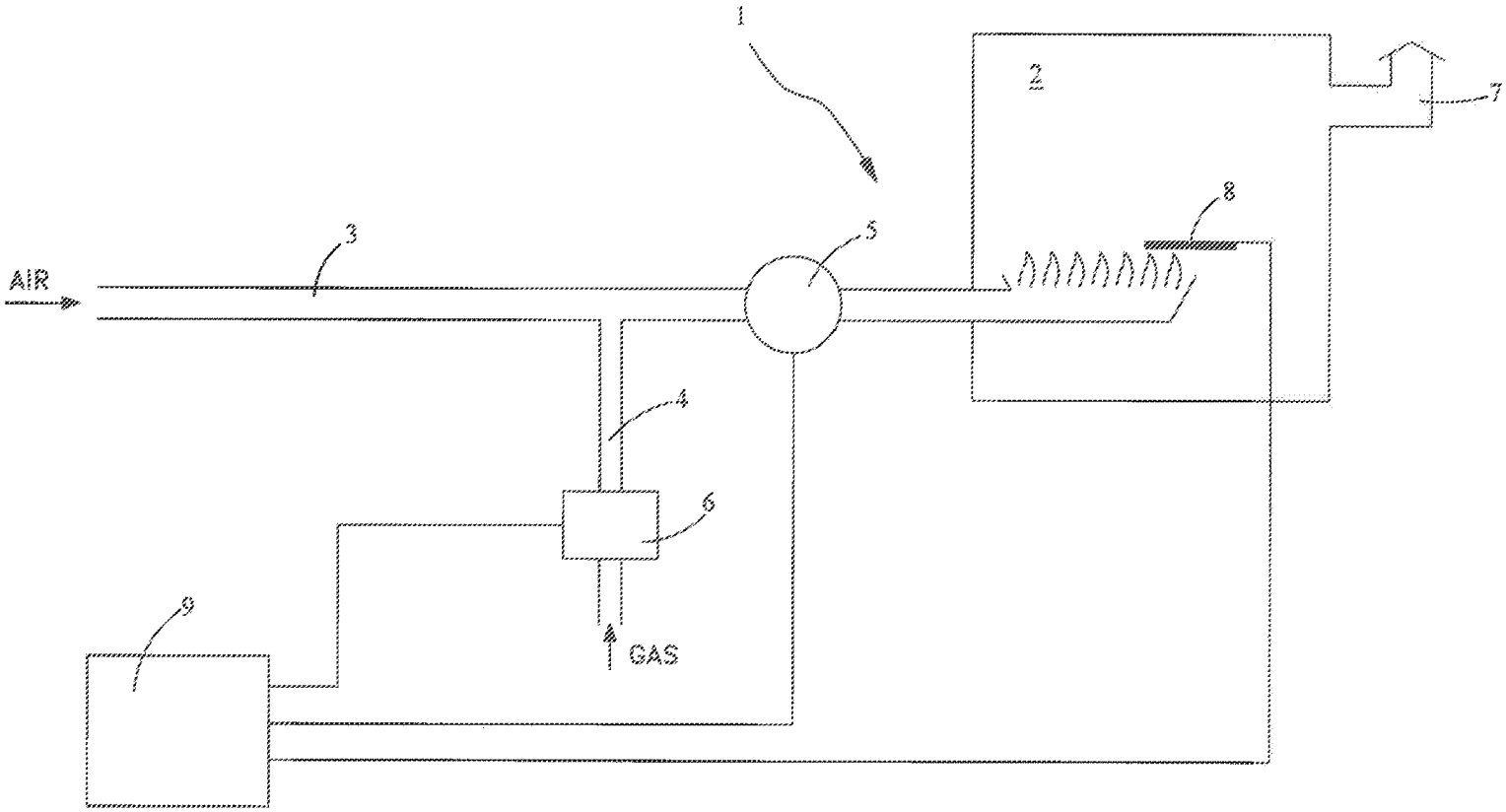
FIG. 1 is a diagrammatic view of a burner of an apparatus provided with a combustion control system operating according to the method for monitoring and controlling combustion according to the invention.

Referring first to FIG. 1, the numeral 1 indicates overall a burner that is provided with a combustion control system, produced so as to operate according to the method for monitoring and controlling combustion of the present invention.

The burner 1 is housed in an apparatus (not shown) intended for the production of domestic hot water and/or coupled to a space-heating system, in a manner known per se and not shown in the drawings.

The burner 1 comprises a combustion chamber 2, which is supplied by a first 3 and a second 4 duct, configured so as to introduce into the combustion chamber 2 a flow of air and, respectively, a flow of fuel gas. Preferably, the second duct 4 enters the first duct 3 upstream of the combustion chamber 2 (premixing burner). In the air-gas mixing section, a fan 5 is provided, with a variable rotation speed. The numeral 6 indicates a modulating valve placed on the gas duct 4 to control the flow rate of gas introduced into the burner.

The combustion chamber 2 is connected downstream to a chimney 7, through which the exhaust gases from combustion are discharged.

The numeral 8 indicates a combustion monitoring sensor, described in greater detail below, which is connected to a control device 9 provided with an electronic circuit suitable for controlling the burner according to the method of the present invention, as shown below. The control device is further connected operationally both to the fan 5 and the modulating valve 6, so as to control those members.

The sensor 8 is positioned close to the burner flame, the burner being capable of receiving a supply from a voltage generator and is also being connected to an electronic circuit suitable for measuring the resultant potential at the sensor.

One embodiment provides for the sensor 8 to comprise two electrodes, indicated as E1, E2, which are placed inside or close to the flame. As an alternative, provision is made for the use of a single electrode, to which the voltage signal is applied and, following the disconnection of said signal, the response signal is immediately acquired by means of a series of samplings of the latter.

From what is known from physics about the plasmas that develop in combustion processes, if a charge is introduced into the plasma from outside, the electrical field produced by said charge results in motion of the charges constituting the plasma; this motion increases in line with the increase in the introduced external charge. However, there is an electrical field value beyond which the flow of charged particles increases no further (saturation). The motion varies considerably in terms of electrons and ions: the electrons, being much lighter and smaller, move much faster and suffer far fewer collisions along their path. This means that the aforesaid saturation phenomenon arises much earlier in the case of positive ions, while it happens later for electrons. Owing to the displacement of charged particles, the macroscopic effect generated by the introduced external charge is a change in the electrical field of the plasma. This electrical field is propagated around the particle by a distance of the order of the "Debye length". In connection with the above, this is greater for electrons, i.e. where the introduced charge is positive. In contrast, it will be much smaller for positive ions, corresponding to the case where the introduced charge is negative.

Returning to the method of the invention, an electrical signal having a given waveform over time is applied to the electrode E1; this potential is equivalent to the perturbing charge mentioned earlier in the description. The electrode E2 is located at a suitable distance and takes a value for potential determined by the motion of the plasma charges caused by E1 and responding to the dynamics described above. This potential is measured by the electronic circuit and processed as described below.

The basic concept of the method of the invention is therefore that the resultant waveform at the electrode E2 is determined unambiguously by the composition of the mixture of oxidising agent and fuel before combustion. It is essential to know this composition in order to be able to predict any key effects of combustion, such as the amount of $CO_2$ and CO produced and the thermal power produced. In this way, it is possible among other things to compensate for the effects of gases other than the nominal ones, indicated in the sector as G20 and G31. Therefore, if we know the air/fuel ratio (air number otherwise marked as "λ"), it is possible to produce a combustion control system for a gas burner apparatus.

The method of the invention essentially comprises two macro operating phases, a first phase, referred to as F, of acquiring and processing data from experimental conditions, and a second phase, referred to as H, aimed at evaluating the air number λ or the amount of $CO_2$ and CO produced or the thermal power produced, under an actual operating condition of the burner.

In turn, both of these phases comprise a sequence of operating steps, which are described in detail below.

The following description sets out the steps relating to evaluation of the air number λ, but they can be applied in the same way for other parameters correlated with combustion. Below, this significant parameter of the characteristics of combustion will also be referred to, in more general terms, as K and this, in addition to the power P of the burner, can be selected, for example, as the air number λ or as the concentration (% or ppm) of $CO_2$ or CO emitted in the combustion process, it being understood that further significant parameters of combustion can also be preselected, as an alternative.

A first operating step of phase F, shown as F1, provides for identifying a plurality (1, 2, . . . , n) of experimental combustion conditions of the burner, in each of which a respective power P (P1, P2, . . . , Pn) is set at a number n of levels and for each power an air number value (λ1, λ2, . . . , λm) is set, selected at a number m of levels, the air number λ expressing the ratio between the amount of air in the combustion process and the amount of air for stoichiometric combustion, each power level n being associated with the respective levels m of the air number, each experimental condition further being repeated a predetermined number r of times. In other words, a grid (m*n) of pairs of values P, λ is produced, in which for each pair of values the condition is repeated r times.

As an alternative, in each experimental condition a power P (P1, P2, . . . , Pn) can be set and for each power a concentration of $CO_2$ and/or CO (% 1, % 2, . . . % n) is set. In this case too, each experimental condition is repeated a predetermined number of times (r).

A second, successive operating step, shown as F2, provides for an electrical signal to be applied to the electrode E1 in each of said (n*m*r) experimental conditions (Pi, λj or Pi, % j).

Reference will be made below to the selection of experimental conditions with the power and air number being set, it being understood that the method can be applied analogously in the alternative selection of experimental conditions with the power and $CO_2$ (and/or CO) concentration being set.

In a third step F3 the resultant signal at the electrode E2 is sampled, calculating the respective characteristic parameters of the waveform of the signal for each of the aforesaid experimental conditions. The term "sampling" means, in greater detail, a series of samplings of the response signal measured at the electrode, in which an analogue/digital conversion of the voltage measured at the electrode is obtained at regular intervals and for a defined duration.

A further, subsequent operating step, shown as F4, provides for calculating a correlation function, on the basis of the acquired experimental data, capable of unambiguously correlating the power P, the air number λ and the characteristic parameters of the waveform of the signal at the electrode E2, in the combustion process of the burner.

The characteristic parameters of the waveform are advantageously obtained by means of techniques of harmonic analysis of the voltage signal sampled by application of a functional transform. Examples of possible choices of functional transform are the Hartley transform or the Fourier transform.

Moreover, the correlation function, which allows the characteristic parameters of the measured waveform to be correlated with the air number λ and the power P, is obtained by application of regression analysis techniques.

In other words, the mechanism allowing the waveform measured at the electrode E2 to be correlated with the air number λ is of the "pattern matching" type and is implemented by applying regression analysis techniques.

In one embodiment, in phase F2, a voltage signal with a periodic waveform, such as a sinusoidal waveform, is applied to the electrode E1 at a constant amplitude M and a given frequency f.

In a preferred embodiment, use is made of a single electrode E1, and the aforesaid operating steps F2 and F3 are performed in immediate succession on the same single electrode. In other words, the electrical voltage signal is applied to the electrode and, following the disconnection of the signal applied, a series of samplings of the resultant response signal at the electrode is carried out.

The discrete Fourier transform (DFT) is applied to the waveform of the signal sampled at the electrode E2, at the frequency of the waveform of the electrode E1 and at its subsequent harmonics, obtaining the amplitude M and phase ϕ for said frequencies.

This operation is carried out for each of the aforesaid experimental conditions, corresponding to the preselected powers (P1, P2, . . . , Pn), and for each of these at the air number values (λ1, λ2, . . . , λm), carrying out a predetermined number (r) of repetitions for each of said conditions, for a total number of observations equal to n*m*r.

At this point, provision is made for:

calculating, for each experimental condition (i, j), the amplitudes (M1*i,j*, M2*i,j*, . . . Mpi,j) and phases (ϕ1*i,j*, ϕ2*i,j*, . . . , ϕpi,j) by applying the discrete Fourier transform (DFT), where p is the harmonic maximum for which the discrete Fourier transform (DFT) is applied, inserting the amplitude (M) and phase (ϕ) values into a linear system in which each row is composed of an experimental observation made at the power Pi and at the air number λj and in which the known term is λj, setting a number of experimental observations (n*m*r) which is greater than the maximum number of harmonics (p), at least equal to 3p−2, solving the linear system of the equation AB=λ with A being the matrix of experimental data, B the vector of the unknown coefficients and λ the vector, by the least-squares regression method, of the Moore-Penrose equation where $$B=(ATA)^{-1}A^{T}$$

storing in the electronic circuit the coefficient vector B, with a dimension equal to the unknowns of the system or equal to the number of columns of the matrix A, so as to use the following regression equation:

$$\lambda_j=\left[1\left(\frac{M_2}{M_1}\right)^s\left(\frac{M_3}{M_1}\right)^s\left(\frac{M_4}{M_1}\right)^s\left(\frac{M_5}{M_1}\right)^s\ldots\left(\frac{M_p}{M_1}\right)^s\sin(\varphi_2-2r\varphi_1)\sin(\varphi_3-3r\varphi_1)\right.$$
$$\sin(\varphi_4-4r\varphi_1)\sin(\varphi_5-5r\varphi_1)\ldots\sin(\varphi_p-pr\varphi_1)\cos(\varphi_2-2r\varphi_1)$$
$$\left.\cos(\varphi_3-3r\varphi_1)\cos(\varphi_4-4r\varphi_1)\cos(\varphi_5-5r\varphi_1)\ldots\cos(\varphi_p-pr\varphi_1)\right]$$

with s and r which may assume a value in the range [1; 4] and p≥5.

Preferred values of p are between 5 and 15.

In phase H of the method, relating to an operating condition of actual functioning of the burner, the following operating steps are provided, to evaluate the air number λ.

A first operating step, referred to as H1, provides for applying the voltage signal to the electrode E1.

Simultaneously (in step H2) provision is made for acquiring the electrical signal at the second electrode (E2) for a predetermined time interval, as described in phase F2.

In a preferred embodiment, use is made of a single electrode E1, and the aforesaid operating steps H1 and H2 are performed in immediate succession on the same single electrode.

In a third, successive step H3, the amplitude (M1, M2, . . . , Mp) and phase (ϕ1, ϕ2, . . . , ϕp) of the waveform of the resultant voltage signal at the electrode E2 are calculated by means of discrete Fourier transform, while in a fourth step H4 the estimated air number value (λstim) is calculated by means of the following scalar product:

$$\lambda_{stim}=\left[1\left(\frac{M_2}{M_1}\right)^s\left(\frac{M_3}{M_1}\right)^s\left(\frac{M_4}{M_1}\right)^s\left(\frac{M_5}{M_1}\right)^s\ldots\left(\frac{M_p}{M_1}\right)^s\right.$$
$$\sin(\varphi_2-2r\varphi_1)\sin(\varphi_3-3r\varphi_1)\sin(\varphi_4-4r\varphi_1)\sin(\varphi_5-5r\varphi_1)$$
$$\ldots\sin(\varphi_p-pr\varphi_1)\cos(\varphi_2-2r\varphi_1)\cos(\varphi_3-3r\varphi_1)$$
$$\left.\cos(\varphi_4-4r\varphi_1)\cos(\varphi_5-5r\varphi_1)\ldots\cos(\varphi_p-pr\varphi_1)\right]\times B$$

using the correlation function, which correlates the power and the air number λ with the characteristic parameters of the waveform observed.

λ can be calculated at predetermined regular intervals, as will be explained in detail below.

Preferably, in the phase of harmonic analysis of the waveform of the signal associated with the electrode E2, provision is made for calculating the amplitude and phase of a preselected number of harmonics.

Advantageously, provision can be made for calculating, in said first phase F of the method, a plurality of vectors B of calibration coefficients, each correlated with respective power bands between the minimum and maximum admissible power, which bands overlap at least in part, in order to achieve greater precision in estimating the air number. For example, three distinct vectors Blow, Bmed and Bhi can be used respectively in three partially superimposed power bands: low, medium and high power. In this way, greater accuracy is obtained than by using a single vector B. Each vector has been determined by using the powers referring to it.

Provision can also be made for calculating a coefficient vector Bfam correlated with the respective gas family for which the burner is intended, so as to allow said gas family to be identified during the burner installation phase. Using Bfam it is possible to estimate the air number independently of the family to which the gas belongs. It is less accurate than other vectors B and can be used only for identifying the family in the installation phase of the apparatus. This simplifies the procedure of installing the burner.

Alternatively, using a method of the aforesaid type, the power can also be estimated, and this may be different from that normally estimated in an open loop, for example by using gases other than the reference gas for the family or for the purposes of adjusting the device for modulating the gas flow rate or for the characteristics of the installation (for example of the application type, relating to the length of the fume discharge duct or if it becomes blocked). This estimated power value can be used in the aforesaid combustion control system, to adjust power also in a closed loop. In this way it is possible also to simplify the procedure for installing the apparatus, with a consequent time-saving.

By using the aforesaid method it is also possible to diagnose conditions of the apparatus that differ from the nominal ones, for example determined by an out-of-tolerance positioning of the electrode or caused by deterioration of the electrode through ageing. All that is needed to do this is to use, instead of λj, a suitable parameter representing the condition of the apparatus (nominal or anomalous) prevailing in the experiment j.

Periodic voltage signals can also be applied to the electrode E1, not at a single frequency but at several frequencies in succession, so that each frequency excites the specific characteristics of the plasma. Alternatively it is possible to apply certain frequencies for certain power levels and other frequencies for other power levels.

It is also possible to apply to E1 a waveform constituted by a superimposed sinusoid at a constant level with a greater value. In that case the parameters observable at E2 are the modulus and phase of the sinusoid of the same frequency and its harmonics and the mean value.

A principal variant of the method of the invention provides for the sensor 8 to be of the single-electrode type, in which the single electrode E1 is supplied with a preselected electrical signal. Preferably, the electrode E1 is supplied with a periodic, pulsed voltage signal.

In a first configuration, the voltage signal comprises, over the signal period, a first pulse with a positive amplitude followed by a second pulse with a negative amplitude. As an alternative, the voltage signal comprises, over the period, a pulse with a positive or negative amplitude.

Advantageously, the frequency of the pulsed signal at the electrode E1 is a function of the power delivered to the burner and, additionally, the sampling frequency is a function of the power delivered to the burner.

Provision can be made for a first sampling frequency of the signal associated with the first pulse and a second, distinct sampling frequency associated with the second pulse.

By analogy with the methods using a dual-electrode sensor, the method in the variant with a single-electrode sensor also provides for:

applying to the waveform observed at the electrode E1 a functional transform, for example the discrete Fourier transform (DFT) at the preselected frequency and at its subsequent harmonics, obtaining the amplitude (M) and phase (D) for said frequencies, carrying out said operation for each of said experimental conditions corresponding to the powers (P1, P2, . . . , Pn), and for each of these at the air number values (λ1, λ2, . . . , λm), carrying out a predetermined number (r) of repetitions for each of said conditions, for a total number of observations equal to n*m*r, calculating, for each experimental condition (i, j), the amplitudes (M1*i,j*, M2*i,j*, . . . Mpi,j) and phases (ϕ1*i,j*, ϕ2*i,j*, . . . , ϕpi,j) by applying the discrete Fourier transform (DFT), where p is the harmonic maximum for which the discrete Fourier transform (DFT) is applied, inserting the amplitude (M) and phase (ϕ) values into a linear system in which each row is obtained from an experimental observation made at the power Pi and at the air number λj and in which the known term is λj, setting a number of experimental observations (n*m*r) which is greater than the maximum number of harmonics (p), solving the linear system of the equation AB=λ with A being the matrix of experimental data, B the vector of the unknown coefficients and λ the vector, by the least-squares regression method, of the Moore-Penrose equation where $$B=(A^TA)^{-1}A^T$$

storing in the electronic circuit the coefficient vector B, with a dimension equal to the unknowns of the system or equal to the number of columns of the matrix A, so as to use the following regression equation:

$$\lambda_j=\left[1\ \left(\frac{M_2}{M_1}\right)^s\left(\frac{M_3}{M_1}\right)^s\left(\frac{M_4}{M_1}\right)^s\left(\frac{M_5}{M_1}\right)^s\ldots\left(\frac{M_p}{M_1}\right)^s\sin(\varphi_2-2r\varphi_1)\sin(\varphi_3-3r\varphi_1)\right.$$
$$\sin(\varphi_4-4r\varphi_1)\sin(\varphi_5-5r\varphi_1)\ldots\sin(\varphi_p-pr\varphi_1)\cos(\varphi_2-2r\varphi_1)$$
$$\left.\cos(\varphi_3-3r\varphi_1)\cos(\varphi_4-4r\varphi_1)\cos(\varphi_5-5r\varphi_1)\ldots\cos(\varphi_p-pr\varphi_1)\right]$$

In this variant too, in phase H of the method, relating to an operating condition of actual functioning of the burner, the following operating steps are provided, to evaluate the air number λ.

A first step H1 provides for acquiring the voltage signal at the electrode E1 for a predetermined time interval; in a second, successive step H2, the amplitude (M1, M2, . . . , Mp) and phase (ϕ1, ϕ2, . . . , ϕp) of the waveform of the signal acquired at the electrode E2 are calculated by means of discrete Fourier transform, while in a third step H3 the estimated air number value (λstim) is calculated by means of the following scalar product:

$$\lambda_{stim}=\left[1\ \left(\frac{M_2}{M_1}\right)^s\left(\frac{M_3}{M_1}\right)^s\left(\frac{M_4}{M_1}\right)^s\left(\frac{M_5}{M_1}\right)^s\ldots\left(\frac{M_p}{M_1}\right)^s\right.$$
$$\sin(\varphi_2-2r\varphi_1)\sin(\varphi_3-3r\varphi_1)\sin(\varphi_4-4r\varphi_1)\sin(\varphi_5-5r\varphi_1)$$
$$\ldots\sin(\varphi_p-pr\varphi_1)\cos(\varphi_2-2r\varphi_1)\cos(\varphi_3-3r\varphi_1)$$
$$\left.\cos(\varphi_4-4r\varphi_1)\cos(\varphi_5-5r\varphi_1)\ldots\cos(\varphi_p-pr\varphi_1)\right]\times B$$

using the correlation function, which correlates the power and the air number λ with the characteristic parameters of the waveform observed.

λ can be calculated at predetermined regular intervals, as will be explained in detail below.

To summarise the preceding phases it can therefore be stated that the parameters of the mathematical model relating to the correlation function, in combination with the functional transform of the waveforms acquired following the stimulus applied to the plasma, are capable of calculating the desired combustion characteristics.

It should be noted that, unlike known methods for monitoring and controlling combustion, the method of the invention is based on measuring voltage rather than on measuring the ionisation current, and is therefore less subject to problems arising from wear and ageing of the electrodes.

Moreover, to determine the calibration parameters (vector B), a predetermined, relatively limited number of experimental tests is required, thus permitting shorter fine-tuning times than in the prior art.

Figure 2:
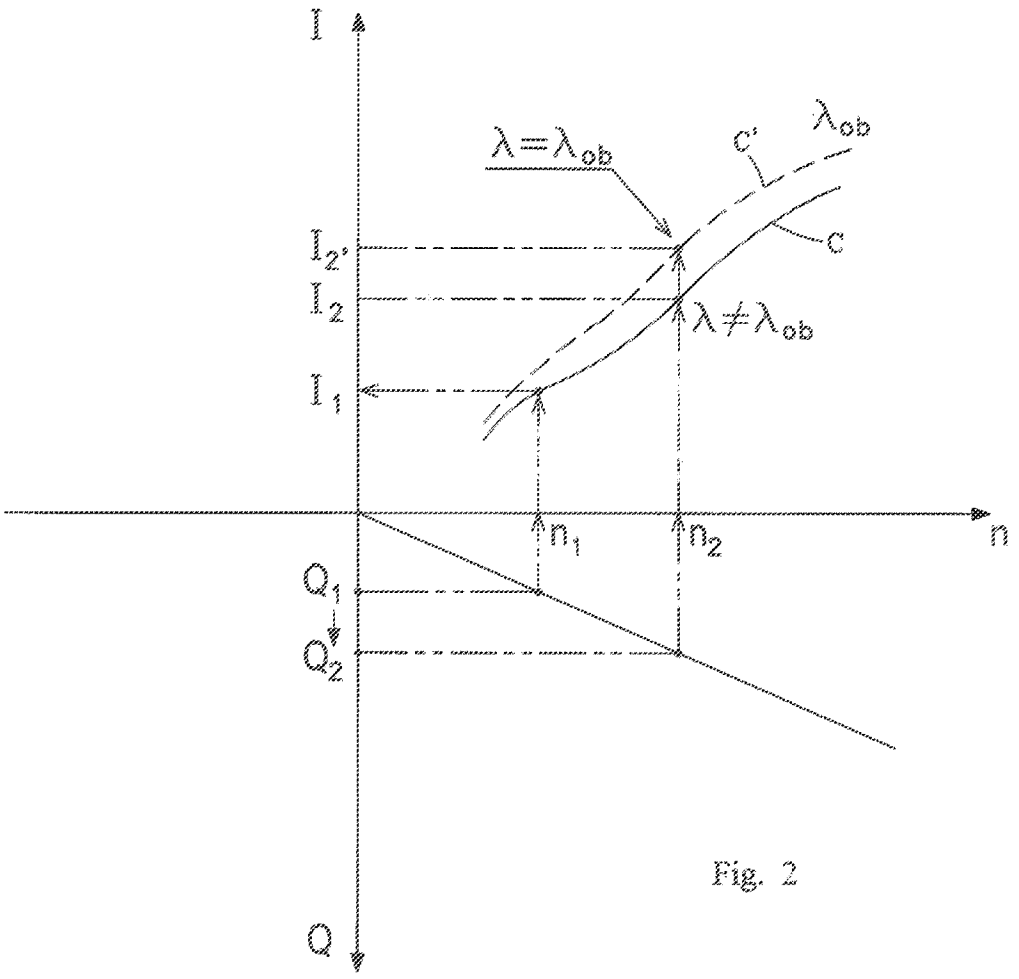
FIG. 2 is a graph showing the curves of correlation between operating parameters of a fan and of a modulating gas valve of a burner apparatus implementing the combustion control method of the invention.

A combustion control and adjustment system for the burner 1, operating by the method of the invention, provides for example for the following operating phases, with reference to the graph in FIG. 2, where the x-axis shows the number of rotations (n) of the fan, the y-axis in its upper quadrant expressing the current (I) for actuating the modulating gas valve, the y-axis in its lower quadrant expressing the flow rate (Q) of gas delivered (correlated with the power requirements).

The adjustment curves c of the aforesaid parameters are typically preset in the control circuit, as shown in the diagram. Therefore, for example, a requirement Q1 has a corresponding number of rotations n1 and current I1.

If the power requirement changes from Q1 to Q2, the number of rotations rises to n2, in which condition the control circuit associates the current value I2 with the modulator. Said values are correlated with a target air number (λob) that is deemed optimal for combustion. In this new operating condition, therefore, the effective air number (λstim) is estimated using the method described above and a comparison is made between λob and λstim, making the appropriate corrections to the parameters—current I—or—number of rotations n—to arrive at an air number which basically coincides with the target air number. Preferably, the current at the modulator is varied, for example raised to the value I2'. At this point the operating curve c is updated again, for the air number equal to the target air number, which then becomes the curve c'.

The control curve can, for example, be updated by accumulating a certain number of correction points and calculating the regression curve correlating said points, this curve becoming the new control curve. Alternatively, it is possible only to make a correction, where appropriate, at each operating point, on the basis of the comparison λob/λstim—without identifying a new operating curve (by means of linear regression).

The adjustment system described above simply represents a non-exhaustive example, for the purposes of applying the method of combustion monitoring and control of the invention. It will be understood that this method makes it possible to provide specific principles for controlling and adjusting the burner operation, according to the respective operating and system requirements, which in any case provide for the comparison between a target air number that is optimal for combustion and the air number estimated by the method of the invention.

The invention therefore achieves the proposed aims, overcoming the limitations revealed in the prior art and demonstrating the advantages over known solutions, as stated.

It should be noted that the method of the invention provides for the acquisition of waveforms which are variable over time, this aspect constituting a feature that, together with the logic for data processing and computing, has a decisive effect on the accuracy and stability of the method and of the control system according to the invention. Such a property differs substantially from the known solutions in which reference is made to currents measured in stationary mode or to stationary measurements of significant parameters of combustion.

It will also be observed that the method of the invention provides for perturbation to be applied to the plasma of the flame (voltage signal applied to the electrode) and, subsequently, once the signal is disconnected, the response signal is acquired from the voltage meter. In this manner, stimulus and measurement occur in two distinct, separate phases. This aspect differs substantially from the known solutions, in which the voltage signal is applied and the effects are observed at the same time, resulting in a mingling of stimulus and response that makes it harder to distinguish one from the other and makes the measurement intrusive and subject to the characteristics of the stimulus, i.e. the electrode and its state of wear and oxidisation.

Furthermore, based on the acquisition of time-domain waveforms, the method of the invention makes it possible to process richer and more complete information on the state of combustion; in fact, what is observed is the dynamic response of the plasma to the stimulus given, rather than the mean response in stationary conditions.

It should also be noted that the model obtained with the method of the invention is valid throughout the operating range of the system, both in desired and undesired operating conditions. It follows that no additional models are needed in order to recognise extreme conditions, for example those involving excessive emission of noxious gases or noisy operation.

The invention claimed is:

1. A method for monitoring and controlling combustion in a burner (1) of a fuel gas apparatus comprising a sensor (8) with an electrode (E1) located in or close to a flame, the burner receiving a power supply from a voltage generator, and the sensor being connected to a control device that measures a potential at the electrode (E1), the method comprising:

a first phase of acquiring and processing data from experimental combustion conditions comprising the following steps:

identifying a plurality of experimental combustion conditions for the burner (1), and for each of said experimental combustion conditions:

applying to the burner a respective power (P1, P2, . . . , Pn) of a number (n) of preselected power levels and a further parameter of combustion characteristics (K1, K2, . . . , Km), at a number (m) of levels, associating with each level (n) of power the respective levels (m) of said further parameter, and each experimental combustion condition being repeated a predetermined number (r) of times, applying, in each of said (n, m) experimental combustion conditions, an electrical voltage signal to said electrode (E1) via the voltage generator and, after disconnecting the electrical voltage signal applied to the electrode, carrying out a series of samplings of a response signal at the electrode, calculating, based on the series of samplings, respective characteristic parameters of a waveform of said response signal for each of said experimental combustion conditions, calculating a correlation function based on acquired experimental data, to correlate said power (P) and said further parameter of the combustion characteristics (K) with the characteristic parameters of the waveform of the response signal at the electrode (E1), in a combustion process of the burner (1), and a second phase of evaluating the further parameters of the combustion characteristics (K), under an operating condition of the burner (1), comprising the following steps:

applying, under said operating condition, an electrical voltage signal to said electrode (E1) via the voltage generator and, following the disconnection of the electrical voltage signal applied to the electrode, carrying out a series of samplings of a response signal at the electrode, calculating, based on the series of samplings, respective characteristic parameters of a waveform of said response signal for said operating condition, and calculating a target combustion characteristic based on said correlation function, wherein said further parameters of the combustion characteristics are selected from at least one of: (1) an air number (λ), defined as a ratio between an amount of air in the combustion process and an amount of air for stoichiometric combustion, and (2) a $CO_2$ or CO concentration in the combustion process.

2. The method according to claim 1, wherein the characteristic parameters of the waveform of the response signals are obtained by applying a functional transform.

3. The method according to claim 1, wherein the correlation function, which allows the measured waveform to be correlated with the further parameter of the combustion characteristics, is obtained by application of regression analysis techniques.

4. The method according to claim 1, wherein a periodic, pulsed voltage signal is applied to the electrode (E1) via the voltage generator.

5. The method according to claim 1, wherein said pulsed voltage signal comprises, over a signal period, a first pulse with a positive amplitude followed by a second pulse with a negative amplitude.

6. The method according to claim 1, wherein said pulsed voltage signal comprises, over a signal period, a pulse with a positive or negative amplitude.

7. The method according to claim 1 further comprising:

applying to the electrode (E1) a voltage with a pulsed, alternating waveform at a constant amplitude (M) and with a predetermined frequency (f), acquiring the response signal after each individual pulse at the electrode, applying to the waveform of the signal acquired at the electrode a discrete Fourier transform (DFT) at a frequency of the waveform of the electrode and at subsequent harmonics, obtaining the amplitude (M) and phase (Φ) for said frequencies, carrying out operation for each of said experimental combustion conditions, corresponding to the powers (P1, P2, . . . , Pn), and for each of these at the air number (λ1, λ2, . . . , λm), carrying out a predetermined number (r) of repetitions for each of said experimental combustion conditions, with a total number of observations equal to n*m*r, calculating, for each experimental combustion condition (i, j), amplitudes (M1*i,j*, M2*i,j*, . . . , Mpi,j) and phases (Φ1*i,j*, Φ2*i,j*, . . . , Φpi,j) by applying the discrete Fourier transform (DFT), where p is the harmonic maximum for which the discrete Fourier transform (DFT) is applied, inserting the amplitude (M) and phase (Φ) values into a linear system in which each row is obtained from an experimental observation made at the power Pi and the air number λj and in which the known term is λj, setting a number of experimental observations (n*m*r) which is greater than a maximum number of harmonics (p), at least equal to 3p−2 solving the linear system of the equation AB=λ with A being a matrix of experimental data, B being a vector of unknown coefficients and λ being an air number vector, by the least-squares regression method, of the Moore-Penrose equation where $$B=(A^TA)^{-1}A^T$$

storing in the control device the coefficient vector B, with a dimension equal to unknowns of the system or equal to the number of columns of the matrix A, so as to use the following regression equation:

$$\lambda_j=\left[1\ \left(\frac{M_2}{M_1}\right)^s\left(\frac{M_3}{M_1}\right)^s\left(\frac{M_4}{M_1}\right)^s\left(\frac{M_5}{M_1}\right)^s\ldots\left(\frac{M_p}{M_1}\right)^s\sin(\varphi_2-2r\varphi_1)\sin(\varphi_3-3r\varphi_1)\right.$$
$$\sin(\varphi_4-4r\varphi_1)\sin(\varphi_5-5r\varphi_1)\ldots\sin(\varphi_p-pr\varphi_1)\cos(\varphi_2-2r\varphi_1)$$
$$\left.\cos(\varphi_3-3r\varphi_1)\cos(\varphi_4-4r\varphi_1)\cos(\varphi_5-5r\varphi_1)\ldots\cos(\varphi_p-pr\varphi_1)\right]$$

with s and r having a value in the range [1; 4] and p≥5, estimating the air number, under an actual operating condition, by the following steps:

acquiring the voltage signal at the electrode for a predetermined time interval, calculating the amplitude (M1, M2, . . . , Mp) and phase (Φ1, Φ2, . . . , Φp) by discrete Fourier transform, and calculating the estimated air number (λstim) by the following scalar product:

$$\lambda_{stim}=\left[1\ \left(\frac{M_2}{M_1}\right)^s\left(\frac{M_3}{M_1}\right)^s\left(\frac{M_4}{M_1}\right)^s\left(\frac{M_5}{M_1}\right)^s\ldots\left(\frac{M_p}{M_1}\right)^s\right.$$
$$\sin(\varphi_2-2r\varphi_1)\sin(\varphi_3-3r\varphi_1)\sin(\varphi_4-4r\varphi_1)\sin(\varphi_5-5r\varphi_1)$$
$$\ldots\sin(\varphi_p-pr\varphi_1)\cos(\varphi_2-2r\varphi_1)\cos(\varphi_3-3r\varphi_1)$$
$$\left.\cos(\varphi_4-4r\varphi_1)\cos(\varphi_5-5r\varphi_1)\ldots\cos(\varphi_p-pr\varphi_1)\right]\times B.$$

8. The method according to claim 7, wherein a sampling frequency is a function of the power delivered to the burner (1).

9. The method according to claim 7, wherein there is a first sampling frequency of the signal associated with positive pulses and a second, distinct sampling frequency associated with negative pulses.

10. The method according to claim 7 further comprising calculating in said first phase a plurality of vectors (B) of calibration coefficients, each correlated with respective power bands (P) between a minimum and maximum admissible power, and at least partly overlapping, in order to achieve greater precision in estimating the air number (λ).

11. The method according to claim 7 further comprising calculating a coefficient vector (Bfam) correlated with a respective gas family for which the burner (1) is intended, to allow said gas family to be identified during burner installation.

12. The method according to claim 7, wherein said burner (1) comprises:

a combustion chamber (2), a first duct (3) capable of introducing air into said combustion chamber (2), a fan (5) associated with said first duct (3), configured to vary the amount of air introduced into said first duct, a second duct (4) capable of introducing a fuel gas into said combustion chamber (2), a modulating valve (6) associated with said second duct (4), configured to vary the amount of gas introduced into said second duct;

said method comprising the phases of:

setting a first one of said fan or said modulating valve (5, 6) to a first setting value, based on control curves preset in the control device, associating a corresponding setting value for a second one of said fan or said modulating valve, said values being correlated with a target air number (λob) that is deemed optimal for combustion, calculating, under the operating condition achieved, the actual air number value (λstim), comparing the target air number (λob) with the actual air number (λstim) and correcting one and/or the second one of said fan or said modulating valve so as to obtain an actual air number (λstim) that substantially coincides with the target air number (λob).

13. The method according to claim 12, wherein said fan (5) has a preselected control curve related to a number of rotations or an air flow rate, and said modulating valve (6) has a preselected control curve related to a current or a gas flow rate, said setting values being the speed of the fan (5) and/or the driving current for the modulating valve (6).

14. A system for controlling combustion in a burner (1) of a fuel gas apparatus, the system operating according to the monitoring and controlling steps of claim 1, the system including a sensor with an electrode (E1) located in or close to a flame, and the burner receiving a power supply from a voltage generator connected to a control device that measures a potential at the electrode (E1).

15. The method according to claim 1, wherein the characteristic parameters of the waveform of the response signals are obtained by applying a functional transform.

16. The method according to claim 8, wherein there is a first sampling frequency of the signal associated with positive pulses and a second, distinct sampling frequency associated with negative pulses.

17. The method according to claim 1, further comprising calculating in said first phase a plurality of vectors (B) of calibration coefficients, each correlated with respective power bands (P) between a minimum and maximum admissible power, and at least partly overlapping, in order to achieve greater precision in estimating the air number (λ).

18. The method according to claim 1, further comprising calculating a coefficient vector (Bfam) correlated with a respective gas family for which the burner (1) is intended, to allow said gas family to be identified during burner installation.

* * * * *